United States Patent [19]

Alexander

[11] Patent Number: 4,893,684

[45] Date of Patent: Jan. 16, 1990

[54] METHOD OF CHANGING WELL FLUID

[75] Inventor: Robert L. Alexander, Spring, Tex.

[73] Assignee: Chevron Research Company, San Francisco, Calif.

[21] Appl. No.: 334,019

[22] Filed: Apr. 5, 1989

Related U.S. Application Data

[63] Continuation-in-part of Ser. No. 63,190, Jun. 17, 1987, abandoned.

[51] Int. Cl.[4] ..... E21B 7/00; E21B 37/04

[52] U.S. Cl. ..... 175/65; 166/153; 166/175; 166/312; 175/262; 175/316; 175/324

[58] Field of Search ..... 175/65, 324, 262, 316; 166/383, 312, 153, 177, 291, 84, 372, 68, 105.5, 175, 202, 243, 311; 15/104.061; 417/555.2

[56] References Cited

U.S. PATENT DOCUMENTS

| | | | |
|---|---|---|---|
| 1,273,548 | 7/1918 | Sheasley | 166/202 X |
| 1,838,539 | 12/1931 | Doherty | 175/65 X |
| 2,959,224 | 11/1960 | Ault | 166/311 |
| 3,065,698 | 11/1962 | Andrew | 166/68 |
| 3,104,714 | 9/1963 | Terrel et al. | 166/153 |
| 3,266,384 | 8/1966 | Searamueci | 417/555.2 |
| 3,500,933 | 3/1970 | Burba, Jr. et al. | 166/311 |
| 4,190,112 | 2/1980 | Davis | 166/153 X |
| 4,453,598 | 6/1984 | Singer et al. | 166/312 |
| 4,515,212 | 5/1985 | Krugh | 166/99 |
| 4,648,447 | 3/1987 | Bishop et al. | 166/173 |
| 4,706,747 | 11/1987 | Schneider | 166/153 |
| 4,706,748 | 11/1987 | Harris | 166/173 |

FOREIGN PATENT DOCUMENTS

| | | | |
|---|---|---|---|
| 871236 | 3/1953 | Fed. Rep. of Germany | 277/206 A |

*Primary Examiner*—Hoang C. Dang

*Attorney, Agent, or Firm*—Edward J. Keeling

[57] ABSTRACT

A well bore annulus wiper plug is disclosed. The wiper plug has a central body and inner and outer elastomeric ribs. The ribs are generally in the shape of truncated cones. To operate the device, it is inserted in the annular space between well casing and a drill string. Fresh drilling mud is circulated downwardly through the annular space above the wiper plug. The wiper plug scrapes both the outside of the drill pipe and the inside of the casing free of a previous well fluid.

2 Claims, 1 Drawing Sheet

METHOD OF CHANGING WELL FLUID

CROSS REFERENCE TO RELATED APPLICATION

This is a continuation-in-part of application Ser. No. 063,190 filed June 17, 1987 now abandoned.

FIELD OF THE INVENTION

This invention is related generally to the field of well 1 bore drilling. Specifically, this invention provides an improved method of cleaning the annular space between drill pipe or tubing and well casing.

BACKGROUND OF THE INVENTION

When drilling oil and gas wells, it is common to circulate drilling mud downwardly through a string of drill pipe, and up the annular space between the drill pipe and the well bore or casing. The drilling mud is then cleaned and recirculated into the drill pipe. Drilling mud serves a number of important purposes including removal of cuttings, lubrication of the drill bit, and providing sufficient pressure on subsurface formations to prevent blowouts.

It is commonly necessary to either switch from one drilling fluid to another or to remove drilling fluid from the hole entirely and introduce, for example, completion fluid or packer fluid. This may be made necessary because it is desired to switch from water to oil based drilling mud, because a mud change out is needed due to excessively high solids build-up in the well, because drilling mud having a substantially different weight (or other properties) is needed, or because drilling operations are complete. It is, of course, generally desirable to completely remove the old fluid or mud system before introducing the new mud, or other fluid, in any of the above situations. This change of fluids frequently occurs after a certain measured depth has been penetrated, and a string of casing has been run. After the cement has set, and prior to drilling out, is an appropriate time to switch drilling fluids (i.e., oil-based mud to water-based mud), when pipe is run into the hole without a drill bit attached to the bottom hole assembly.

Previously, this has been accomplished by any one of a number of methods, all of which are undesirable because they are excessively time-consuming (and, therefore, costly due to lost rig time), or ineffective because drilling mud remains stuck to the sides of the drill pipe, tubing, casing, or both. If, for example, it is desirable to switch from oil-based mud to water-based mud, a large volume of water-based mud may need to be circulated through the hole and disposed of in order to remove all oil-based mud from the system.

For example, U.S. Pat. No. 4,453,598 describes a method of eliminating drilling mud from a well system which requires circulation of clean water followed by circulation of water treated with a surfactant and alcohol. This method would clearly involve significant amounts of rig time to effectively clean the well. Furthermore, even after the work was complete, there would be no assurance that the casing, drill pipe or tubing would be completely clean.

In U.S. Pat. No. 4,515,212 a casing wiper tool is discussed which is affixed to a conventional drill string and run into the hole. No means of scraping the drill pipe or tubing itself is provided without tripping the pipe out of the hole.

Similarly, U.S. Pat. No. 3,500,933 describes a device which provides molded rubber cups for wiping the casing wall. Again, no means of cleaning the drill pipe or tubing is provided.

In U.S. Pat. No. 1,838,539, the flow of drilling mud past a geologic formation is restricted by withdrawing a piston to lower the pressure to enhance the flow of oil and/or gas into the well bore. While flow is restricted, there is no indication of how a second fluid can clearly replace a prior fluid. Nor is there any indication that patentee's device will scrape the first fluid from the drill string or tubing, and casing.

In U.S. Pat. No. 2,959,224, a casing scraper cleans the inside of casing as well as the outside of the drill pipe. However, the device is comprised of metal components, including, the entire body section, as well as springs, stop rings, nuts, and bolts. The device must therefore be retrieved (which would preclude a fluid transfer) or be milled out. Milling out such a device is very expensive, as additional drill bits are required and a great deal of costly rig time is added.

It is desirable, therefore, to provide a well casing wiper that can be utilized to effectively scrape both the outside of a drill string or tubing and the inside of the casing, and especially to separate or prevent the mixing of, for example, different drilling fluids.

SUMMARY OF THE INVENTION

The present invention provides a simple, inexpensive, and efficient method and apparatus for scraping both the outside of a string of drill pipe or tubing and the inside of a casing string, especially when it is desirable to prevent the mixing of two drilling fluids. The apparatus comprises a cylindrical body adapted to fit between an outer and an inner tubular member, a plurality of outer ribs extending from the outside of the body, and a plurality of inner ribs extending from the inside of the body. The outer and inner ribs are adapted to fit snugly into the outer tubular member, and around the inner tubular member. In a preferred embodiment, the wiper plug is made of an elastomeric material and is adapted to fit in the annular space between a drill string or tubing and a well casing.

DETAILED DESCRIPTION OF THE INVENTION

The present invention provides a simple and effective method of scraping the annulus between two tubular members, and especially to separate drilling fluids during a changeover.

Figure 1:
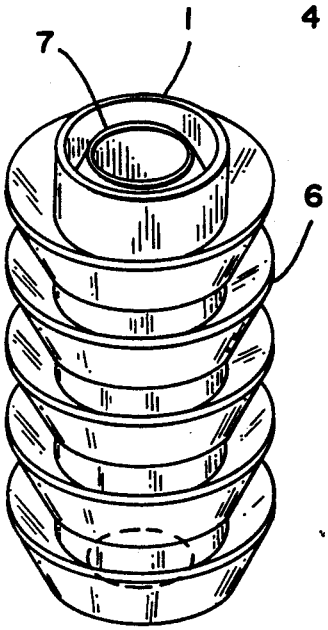
FIG. 1 is an isometric view of the annular wiper plug.
Figure 2:
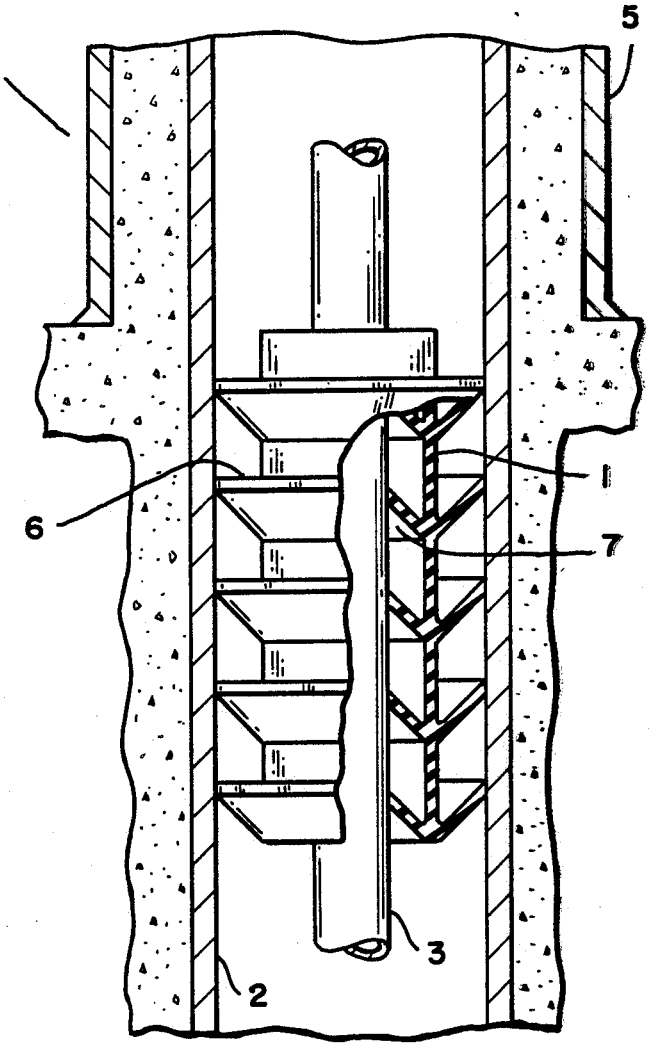
FIG. 2 is a side view of the annular wiper plug, partially cutaway, in position in a well.
Figure 3:
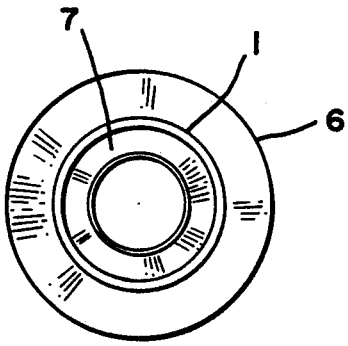
FIG. 3 is a top view of the annular wiper plug.

Referring to FIGS. 1, 2 and 3 in general, the annular wiper plug is provided with a cylindrical control body 1 having a central annular space. The body is generally adapted to fit in the annular space between a well casing 2 and an inner tubular member 3 which, for example, could be tubing or drill pipe. Well casing 2 can be cemented into surrounding formation 4 and may be provided with additional strings of casing 5 which may be surface casing.

On the exterior of central body 1 are a plurality of outer ribs 6. These outer ribs may be in the shape of truncated cones as shown or may extend from the body at substantially a right angle. These ribs are made of an elastomeric material, such as rubber. The outer diameter of outer ribs is selected such that they will be compressed slightly when placed in casing 2.

On the interior of central body 1 are a plurality of inner ribs 7, generally in the shape of truncated cones. Inner ribs 7 may also be inclined back from central body 1 or at a substantially right angle thereto. They are made of an elastomeric material which may also be rubber. The inner diameter of inner ribs 7 is selected such that they will be compressed slightly when placed around inner tubular member 3.

In operation at a producing well, or after casing has been set at a drilling well, an elastomeric annular wiper plug is inserted into the well bore by placing the wiper plug around an inner tubular member at the surface, which does not include a drill bit attached to the lower end. A new drilling fluid is pumped into the well on top of the wiper plug in a reverse-circulation manner until the wiper plug reaches the effective depth of the well. The plug will proceed downwardly through the annular space between the casing and the drill string or tubing. The ribs will effectively wipe any "old" drilling mud from the casing/drill string. Upon reaching the bottom of the drill string or tubing the wiper plug would settle to the bottom of the well, be retrieved, or be drilled out, or left in place. The simple construction of the tool would render it inexpensive and, therefore, disposable. For a drilling well, it is then a routine matter of tripping out to attach a drill bit to the lower end of the drill pipe, and tripping back in to resume drilling operations with the new drilling fluid.

In most commonly encountered situations, the fluid velocity which can be generated by circulating mud in the hole is insufficient to effectively clean the well-bore between the casing and tubing/drill pipe. The present invention provides a method for doing so. Because the inside of the tubing/drill pipe has a significantly smaller cross-sectional area than the annular space between the casing and tubing/drill pipe, it is possible to circulate mud such that turbulent flow is created inside the tubing/drill pipe, which will effectively clean the inner wall of the tubing.

It would also be possible to arrange for easy retrieval of the wiper plug should it ever be necessary to do so. For example, by providing a tubing sub with bypass vents near the bottom of the tubing string, fluid will bypass the wiper plug when it reaches the bottom of the tubing string; and the wiper plug will remain on the tubing string for later retrieval, if desired.

The present invention provides a means of thoroughly scraping the drill string and casing, especially for fluid change-outs. Intermixing of the fluids is eliminated, and a minimum investment of time is required to utilize the tool.

It is to be understood that the above-described embodiments are intended to be illustrative and not restrictive. Many modifications to the invention would be readily apparent to one skilled in the art. For example, the wiper plug could be used in wells other than oil and gas wells (for example, geothermal wells). The scope of the invention should, therefore, not be limited by reference to the above embodiments, but instead, with reference to the appended claims, along with the full scope of equivalents thereto.

What is claimed is:

1. A method of changing well fluid comprising the steps of:

(a) performing well drilling operations with a first drilling fluid and then setting casing;

(b) inserting around an inner tubular member which does not include drill bit attached to the lower end thereof an elastomeric annular wiper plug into an annular space between the well casing and the inner tubular member, said annular wiper plug having inner and outer ribs said outer ribs adapted to fit snugly into said well casing and said inner ribs adapted to fit snugly around said inner tubular member said annular space substantially filled with a first well fluid;

(c) circulating a second well fluid downwardly through the annular space between the casing and inner tubular member above said wiper plug, said wiper plug wiping the outside of said inner tubular member with said inner ribs and the inside of said casing with said outer ribs said wiper plug preventing the mixing of said first well fluid and said second well fluid;

(d) tripping out to attach a drill bit to the lower end of said inner tubular member, and tripping back in; and (e) performing well drilling operations with said second well fluid.

2. A method as recited in claim 1 wherein said well fluids are drilling mud.

* * * * *